US010734130B2

(12) United States Patent
Dablement et al.

(10) Patent No.: US 10,734,130 B2
(45) Date of Patent: Aug. 4, 2020

(54) ELECTRICAL CABLE WITH IMPROVED RESISTANCE TO GALVANIC CORROSION

(71) Applicant: NEXANS, Courbevoie (FR)

(72) Inventors: Sébastien Dablement, Oisy (FR); Stéphane Morice, Leforest (FR)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 16/092,145

(22) PCT Filed: Apr. 6, 2017

(86) PCT No.: PCT/FR2017/050820

§ 371 (c)(1),
(2) Date: Oct. 8, 2018

(87) PCT Pub. No.: WO2017/178734

PCT Pub. Date: Oct. 19, 2017

(65) Prior Publication Data

US 2019/0164660 A1 May 30, 2019

(30) Foreign Application Priority Data

Apr. 11, 2016 (FR) ..... 16 53176

(51) Int. Cl.
*B21C 1/02* (2006.01)
*H01B 7/295* (2006.01)
(Continued)

(52) U.S. Cl.
CPC ..... *H01B 1/023* (2013.01); *B21C 1/003* (2013.01); *B21C 1/02* (2013.01); *H01B 1/026* (2013.01);
(Continued)

(58) Field of Classification Search
CPC ..... H01B 1/023; H01B 1/026; H01B 7/295; H01B 13/0036; H01B 3/441; H01B 13/148; B21C 1/003; B21C 1/02; B22D 11/0602
(Continued)

(56) References Cited

U.S. PATENT DOCUMENTS 3,463,620 A * 8/1969 Winter ..... B23K 20/001 428/612
3,795,760 A * 3/1974 Raw ..... B21C 23/22 174/128.1
(Continued)

FOREIGN PATENT DOCUMENTS

CN 2907973 6/2007
CN 201584224 U 9/2010
(Continued)

OTHER PUBLICATIONS

International Search Report dated Jun. 22, 2017.
Chinese Office Action dated Feb. 28, 2020.

*Primary Examiner* — Timothy J Thompson
*Assistant Examiner* — Michael F McAllister
(74) *Attorney, Agent, or Firm* — Sofer & Haroun, LLP

(57) ABSTRACT

The invention relates to an elongated electrically conductive copper-aluminum bimetal element, a cable comprising at least one such elongated electrically conductive element, a process for preparing said elongated electrically conductive element and said cable, and a device comprising such an electric cable and at least one metal connector.

17 Claims, 2 Drawing Sheets

(51) Int. Cl.

| | |
|---|---|
| ***H01B 1/02*** | (2006.01) |
| ***B21C 1/00*** | (2006.01) |
| ***H01B 13/00*** | (2006.01) |
| *H01B 13/14* | (2006.01) |
| *B22D 11/06* | (2006.01) |
| *H01B 3/44* | (2006.01) |

(52) U.S. Cl.
CPC ..... *H01B 7/295* (2013.01); *H01B 13/0036* (2013.01); *B22D 11/0602* (2013.01); *H01B 3/441* (2013.01); *H01B 13/148* (2013.01)

(58) Field of Classification Search
USPC ..... 174/74 R
See application file for complete search history.

(56) References Cited

U.S. PATENT DOCUMENTS 3,800,405 A * 4/1974 Ziemek ..... B23K 20/001 228/126
4,522,784 A * 6/1985 Enright ..... B22D 11/11 148/411
5,087,300 A * 2/1992 Takayama ..... B21B 1/16 29/527.2
5,223,349 A * 6/1993 Kudo ..... B21C 37/042 428/652
5,476,725 A * 12/1995 Papich ..... B22D 11/008 148/523
7,105,740 B2 * 9/2006 Allaire ..... H01B 1/026 174/36
9,732,218 B2 * 8/2017 Avakian ..... C08L 69/00
2006/0102368 A1 * 5/2006 Michel epouse Allaire ..... H01B 1/026 174/36
2011/0079427 A1 * 4/2011 Powale ..... H01B 3/427 174/72 A
2013/0233586 A1 9/2013 Park et al.
2015/0086807 A1 * 3/2015 Song ..... B23K 9/167 428/652
2016/0133353 A1 * 5/2016 Liu ..... H01B 3/30 174/126.2

FOREIGN PATENT DOCUMENTS

CN 102069162 5/2011
CN 105427921 3/2016

* cited by examiner

ELECTRICAL CABLE WITH IMPROVED RESISTANCE TO GALVANIC CORROSION

RELATED APPLICATION

This application is a National Phase of PCT/FR2017/050820, filed on Apr. 6, 2017, which claims the benefit of priority from French Patent Application No. 16 53176, filed on Apr. 11, 2016, the entirety of which are incorporated by reference.

BACKGROUND

Field of the Invention

The invention relates to an elongated electrically conductive copper-aluminum bimetal element, a cable comprising at least one such elongated electrically conductive element, a process for preparing said elongated electrically conductive element and said cable, and a device comprising such an electric cable and at least one metal connector.

The invention applies typically, but not exclusively, to data transmission cables and to electric cables intended for the transmission of power, in particular to low-voltage power cables (in particular less than 6 kV) or medium-voltage power cables (in particular from 6 to 45-60 kV) or high-voltage power cables (in particular greater than 60 kV, and that may range up to 800 kV), whether for DC or AC current, in the fields of aeronautics, automatic operation, the construction industry, the medical industry, mining, petroleum and gas exploitation, overhead, submarine, terrestrial or railroad power grids, railroad or ground transportation, the shipbuilding industry, the nuclear industry or else the renewable energy industry.

More particularly, the invention relates to an electrically conductive element having an improved resistance to galvanic corrosion, leading to an improvement in the mechanical strength of the connectors and/or accessories generally connected to such an electrically conductive element and the maintaining of the electrical contact between such an electrically conductive element and said connectors and/or accessories. The invention also relates to an electrically conductive element having good mechanical properties, especially in terms of drawability and annealability, and electrical properties, especially in terms of electrical conductivity.

Description of Related Art

It is known to replace copper, generally used in the electrical conductors of electric cables, with aluminum in order to reduce their production cost and their weight. However, the use of aluminum is limited by its poor electrical contact properties. Specifically, aluminum in contact with oxygen from the air naturally oxidizes to form a thin insulating alumina (aluminum oxide $Al_2O_3$) layer at the surface of the aluminum. This layer protects the aluminum from corrosion but has the drawback of opposing the passage of the current at the location where the conductor is connected to the various devices or to the junctions of an electric circuit. In particular, this layer is created in the connection zones (i.e. in the connector-conductor contact zones), which prevents the current from passing from the conductor to the connector (e.g. crimping terminal). The connector may be intended to conduct currents of very varied, or even high, intensities and voltages when it connects electric cables. The environmental conditions (e.g. differential thermal expansion, vibrations, etc.) may make this oxide layer change under the effect of the passage of the current and lead to a rupture of contact in the case of low currents, a temperature rise in the case of high currents, or a fire. Indeed, if the temperature rise of the conductors is too high, the electrically insulating layer may melt until the melting point of the aluminum is reached, leading to the initiation of a fire, and optionally the spread thereof.

Furthermore, the connectors generally used in the field of electric cables to connect the conventional copper or copper alloy electrical conductors are made of copper or of copper alloy covered by a thin layer of tin, silver, gold and/or nickel. However, these metals exhibit a galvanic potential difference with aluminum, and in the presence of moisture, especially saline moisture, the aluminum is very rapidly corroded. This phenomenon is commonly referred to as galvanic corrosion and originates from the combination of the following three conditions: the presence of at least two metals of different natures and having a different redox potential; the bringing of these two metals into electrical contact; and the presence of water acting as electrolyte and covering the two metals. A (short-circuited) galvanic cell is then formed and the galvanic corrosion of the aluminum occurs.

One well-known solution is to make the connector-aluminum conductor contact zones impermeable with grease and sleeves, thus preventing water and oxygen from penetrating these zones. However, this solution is expensive.

Other solutions to try to limit the problem of galvanic corrosion consist in coating an aluminum conductor with a layer of metal that has a galvanic potential identical or similar to that used to manufacture the connector, for example with a thin layer of nickel, tin, zinc or copper deposited by electrodeposition, or with a thin layer of copper deposited by plating or by the rolling-welding technique (sold under the reference CCA 10% or 15% for "copper clad aluminum 10% or copper clad aluminum 15%"). In particular, EP 1 693 857 A1 describes an electrical conductor comprising an aluminum or aluminum alloy core coated with a metal layer made of tin-zinc alloy. However, the aforementioned steps of depositing the coating layer (electrodeposition, plating, rolling-welding) have a high production cost. Furthermore, although these solutions make it possible to reduce the rate of galvanic corrosion, they do not prevent the galvanic corrosion phenomenon as such. Whatever solution is used, the aluminum corrodes more or less quickly and this results in a reduction in the mechanical strength of the connectors.

Objects and Summary

The objective of the invention is to overcome the drawbacks of the prior art and to provide an electrical conductor that has an improved resistance to galvanic corrosion, while guaranteeing good mechanical properties, especially in terms of drawability and annealability, and electrical properties, especially in terms of electrical conductivity. In particular, a good resistance to galvanic corrosion can enable an improvement in the mechanical strength of the connectors and a maintaining of the electrical contact, without having to consequently modify the connectors customarily used.

A first subject of the invention is therefore an elongated electrically conductive element comprising an aluminum or aluminum alloy core and a copper or copper alloy layer surrounding said aluminum or aluminum alloy core, characterized in that the copper or copper alloy layer represents a volume greater than 30% approximately of the volume of the elongated electrically conductive element.

Owing to this copper or copper alloy layer having a volume greater than 30% approximately surrounding said aluminum or aluminum alloy core, the thickness of copper or copper alloy is sufficient so that the resistance of the elongated electrically conductive element to galvanic corrosion is improved.

In one particular embodiment, the elongated electrically conductive element has a resistance to galvanic corrosion when it is subjected to an exposure to a salt spray of at least 50 h approximately, preferably of at least 60 h approximately, more preferably of at least 90 h, and more preferably of at least 120 h.

Advantageously, the elongated electrically conductive element has a reduction of at most 20% approximately, preferably of at most 10%, and more preferably of at most 5%, in newtons, of the mechanical strength of the terminals in a tensile test, when it is subjected to an exposure to a salt spray of at least 50 h approximately, preferably of at least 60 h approximately, more preferably of at least 90 h, and more preferably of at least 120 h.

The copper or copper alloy layer may represent a volume less than or equal to 90% of the volume of the elongated electrically conductive element.

According to one embodiment of the invention, the copper or copper alloy layer represents at least 35% by volume approximately, preferably from 40% to 80% by volume approximately, preferably from 42% to 80% by volume approximately, more preferably from 45% to 70% by volume approximately, and more preferably 50% to 65% by volume approximately, of the volume of the elongated electrically conductive element.

If the amount of copper is greater than 80% by volume approximately, the elongated electrically conductive element of the invention has too high a production cost. If the amount of copper is less than or equal to 30% by volume approximately, the elongated electrically conductive element of the invention does not have sufficient resistance to galvanic corrosion, in particular in harsh environments.

In the invention, the expression "elongated electrically conductive element" means an electrically conductive element having a longitudinal axis. In particular, the electrically conductive element is elongated because it has undergone at least one drawing step (cold deformation step, especially through dies made of diamond).

In one particular embodiment, the copper or copper alloy layer is the outermost layer of the elongated electrically conductive element.

In the invention, the expression "said copper layer is the outermost layer of the elongated electrically conductive element" means that the copper layer of the elongated electrically conductive element of the invention is not covered by any other metal layer.

In other words, the whole of the outer surface of the copper layer (i.e. the whole of the surface furthest from the elongated electrically conductive element) is not covered by any other metal layer.

However, it is also possible depending on the envisaged application, for the copper or copper alloy layer to be covered by a metal layer comprising a metal chosen from tin, silver, nickel, gold, an alloy of the aforementioned metals and a mixture thereof. This metal layer is then the outermost layer of the elongated electrically conductive element and makes it possible to improve the electrical contact with the connector as is commonly carried out.

The copper or copper alloy layer extends in particular along the longitudinal axis of the elongated electrically conductive element.

The copper or copper alloy layer preferably has a substantially regular surface. Thus, the copper or copper alloy layer forms a continuous envelope (without irregularities or without roughness) surrounding said aluminum or aluminum alloy core.

The elongated electrically conductive element has an external diameter ranging from 0.01 to 30 mm approximately, and preferably ranging from 0.05 to 8 mm.

At equivalent diameters, the elongated electrically conductive element of the invention has a lower operating temperature (at constant current) or a greater current capacity (at constant operating temperature) than those of the prior art (i.e. those with no copper layer or having a copper layer that represents a volume less than or equal to 30% approximately).

At equivalent diameters, the elongated electrically conductive element of the invention also has better mechanical properties such as a greater tensile strength than those of the prior art (i.e. those with no copper layer or having a copper layer that represents a volume less than or equal to 30% approximately).

In one particular embodiment of the invention, the copper or copper alloy layer is directly in contact (i.e. in direct physical contact) with the aluminum or aluminum alloy core.

In other words, the elongated electrically conductive element of the invention has no intermediate layer(s) positioned between the aluminum or aluminum alloy core and the copper or copper alloy layer.

The aluminum or aluminum alloy core preferably has a round cross-sectional shape.

The aluminum content of the aluminum alloy may be at least 95.00% by weight approximately, preferably at least 98.00% by weight approximately, preferably at least 99.00% by weight approximately, more preferably at least 99.50% by weight approximately; and preferably at least 99.80% by weight approximately.

An aluminum content of the aluminum alloy of at least of at least 99.00% has the advantage of improving the conductivity of the elongated electrically conductive element and also its drawability and annealability. Specifically, such a minimum aluminum content of the aluminum alloy makes it possible to manufacture cables of great length (e.g. length of at least 1 km) while avoiding the presence of structural defects and/or to obtain a more rigid elongated electrically conductive element.

Furthermore, when the aluminum is pure or when the aluminum alloy comprises at least 99% by weight of aluminum, the bending of the elongated electrically conductive element is facilitated, which enables easier handling.

The copper content of the copper alloy may be at least 95.00% by weight approximately, preferably at least 98.00% by weight approximately, and more preferably at least 99.50% by weight approximately.

A second subject of the invention is a process for manufacturing an elongated electrically conductive element in accordance with the first subject of the invention comprising at least one step i) of forming a copper or copper alloy layer around an aluminum or aluminum alloy core by electrodeposition, plating, rolling-welding, extrusion or else by casting (e.g. continuous casting).

The aluminum or aluminum alloy core and the copper or copper alloy layer are as defined in the first subject of the invention.

The choice of the technique used for coating the aluminum or aluminum alloy core with a copper or copper alloy layer will depend on the mechanical properties of the elongated electrically conductive element that it is desired to obtain.

According to one particularly preferred embodiment of the invention, the step i) of forming a copper or copper alloy layer around an aluminum or aluminum alloy core is carried out by casting.

Indeed, the inventors have surprisingly discovered that unlike the other aforementioned methods, casting makes it possible to obtain an electrically conductive element that can be easily drawn. Owing to the casting, the copper layer has a better adhesion to the aluminum or aluminum alloy core. In particular, the copper-aluminum bond obtained by casting is a chemical and mechanical bond, which differentiates it from purely mechanical bonds or purely chemical bonds that generally result in a delamination of the copper layer in particular during the drawing and/or other shaping steps.

A good drawability makes it possible to have a line speed that is compatible with current production standards.

The methods from the prior art such as the formation of a copper sheet around an aluminum core followed by welding (method well known as the "cladding method") generally produce elongated conductors that cannot be drawn or are difficult to draw.

In particular, the metals used (implemented) during step i) of forming a copper or copper alloy layer around an aluminum or aluminum alloy core by casting may be:

for the copper or the copper alloy, in the liquid state, and for the aluminum or the aluminum alloy, in the liquid or solid state.

When the aluminum or the aluminum alloy is in the solid state, it may be in the form of a solid bar, in particular having a cross section that is round, rectangular or any other shape.

When the aluminum or the aluminum alloy is in the solid state, step i) is a step i-1) during which copper or a copper alloy in the liquid state is cast on aluminum or an aluminum alloy in the solid state, or aluminum or aluminum alloy in the solid state is immersed in copper or a copper alloy in the liquid state, in particular in a liquid bath of copper or of a copper alloy.

In one particular embodiment, the casting temperature during step i-1) ranges from 1086° C. to 1400° C. approximately, and preferably from 1090° C. to 1200° C. approximately.

In one particular embodiment, the cooling during the casting step i-1) is carried out at a rate of at least 50° C./min, and preferably of at least 100° C./min, from the casting temperature down to a temperature below or equal to 660° C. approximately or down to a temperature below or equal to 300° C. approximately depending on the following step carried out.

In particular, the temperature may be below or equal to 660° C. approximately when the following step is a hot rolling step; and the temperature may be below or equal to 300° C. approximately when the following step is a cold rolling step.

By way of example, the casting step i-1) may be carried out continuously.

In particular, the casting step i-1) may be of horizontal type, of vertical type or carried out with the aid of a rotary wheel, referred to as a "casting" wheel.

Among the continuous casting technologies that can be used according to the invention, mention may be made of Southwire® technology, Properzi® technology, Contirod® technology, "dip-forming" technology, Upcast® technology or else "direct chill casting" technology.

When the aluminum is in the liquid state, step i) is a step i-2) during which a hollow element made of copper or of copper alloy, in particular in the form of a tube, especially having a cross section that is round, trapezoidal, triangular or any other shape, is preformed from copper or a copper alloy in the liquid state; then said hollow element is cooled; then the hollow element is filled with aluminum or an aluminum alloy in the liquid state; then the assembly obtained is cooled.

In one particular embodiment, the casting temperature during the step of preforming the hollow element ranges from 1086° C. to 1400° C. approximately, and preferably from 1090° C. to 1200° C. approximately.

In one particular embodiment, the cooling of the hollow element is carried out at a rate of at least 50° C./min, and preferably of at least 100° C./min, from the casting temperature down to a temperature below or equal to 900° C. approximately.

In one particular embodiment, the casting temperature during the step of filling the hollow element ranges from 661° C. to 900° C. approximately, and preferably from 670° C. to 800° C. approximately.

In one particular embodiment, the cooling of the assembly is carried out at rate of at least 50° C./min, and preferably of at least 100° C./min, from the casting temperature down to a temperature below or equal to 660° C. approximately or down to a temperature below or equal to 300° C. approximately depending on the following step carried out.

In particular, the temperature may be below or equal to 660° C. approximately when the following step is a hot rolling step; and the temperature may be below or equal to 300° C. approximately when the following step is a cold rolling step.

By way of example, the casting step i-2) may be carried out continuously.

In particular, the casting step i-2) may be of horizontal type, of vertical type or carried out with the aid of a rotary wheel, referred to as a "casting" wheel.

Among the continuous casting technologies that can be used according to the invention, mention may be made of Southwire® technology, Properzi® technology, Contirod® technology, Upcast® technology or else "direct chill casting" technology.

The process may further comprise a rolling step ii) after the step i) of forming the copper or copper alloy layer. The rolling may be carried out hot or cold.

The process may further comprise, after step i) or step ii), a drawing step iii). This makes it possible to obtain an elongated electrically conductive element having the desired diameter.

Step iii) may be carried out with a line speed that varies from 600 m/min to 3000 m/min approximately.

The process may further comprise, after the drawing step iii), an in-line annealing step iv). This makes it possible to improve the elongation properties of the elongated electrically conductive element. This may also reduce its mechanical strength.

Step iv) may be carried out at a temperature ranging from 100° C. to 600° C. approximately, and preferably from 200° C. to 500° C. approximately.

Step iv) may result in an elongation of at least 20% approximately, and preferably of at least 30% approximately.

When the aluminum is pure or when the aluminum alloy comprises at least 99% by weight of aluminum, step iv) is facilitated. This thus makes it possible to work at lower annealing temperatures and thus to avoid damaging the copper or copper alloy layer.

The elongated electrically conductive element in accordance with the first subject is capable of being obtained according to a process in accordance with the second subject of the invention.

A third subject of the present invention is an electric cable comprising at least one elongated electrically conductive element as defined in the first subject of the invention or as obtained according to a process in accordance with the second subject of the invention, and at least one polymer layer surrounding said elongated electrically conductive element.

In one preferred embodiment, said polymer layer is directly in contact with the copper layer of the elongated electrically conductive element.

It may also be in direct physical contact with the metal layer as defined in the first subject of the invention.

The polymer layer may be an electrically insulating layer or an electrically insulating protective sheath.

In the present invention, the expression "electrically insulating layer" means a layer of which the electrical conductivity may be at most $1\times10^{-8}$ S/m approximately (at 25° C. with direct current).

According to one particularly preferred embodiment of the invention, the polymer layer comprises a polymer material chosen from crosslinked and non-crosslinked polymers, and polymers of inorganic type and of organic type.

The polymer material may be a homopolymer or a copolymer having thermoplastic and/or elastomeric properties.

The polymers of inorganic type may be polyorganosiloxanes.

The polymers of organic type may be polyolefins, polyurethanes, polyamides, polyesters, polyvinyls or halogenated polymers, such as fluorinated polymers (e.g. polytetrafluoroethylene PTFE) or chlorinated polymers (e.g. polyvinyl chloride PVC).

The polyolefins may be selected from ethylene and propylene polymers. By way of example of ethylene polymers, mention may be made of linear low-density polyethylenes (LLDPE), low-density polyethylenes (LDPE), medium-density polyethylenes (MDPE), high-density polyethylenes (HDPE), ethylene-vinyl acetate copolymers (EVA), ethylene-butyl acrylate copolymers (EBA), ethylene-methyl acrylate copolymers (EMA), ethylene-2-ethylhexyl acrylate copolymers (2HEA), copolymers of ethylene and of alpha-olefins such as, for example, polyethylene-octenes (PEO), ethylene-propylene copolymers (EPR), ethylene/ethyl acrylate copolymers (EEA), or ethylene-propylene terpolymers (EPT) such as, for example, ethylene-propylene diene monomer terpolymers (EPDM).

In the present invention, the expression "low-density polyethylene" means a polyethylene having a density ranging from 0.91 to 0.925 approximately.

In the present invention, the expression "high-density polyethylene" means a polyethylene having a density ranging from 0.94 to 0.965 approximately.

The polymer layer may comprise at least 10% by weight approximately, and preferably at least 30% by weight approximately of polymer(s), relative to the total weight of the layer.

The polymer layer make further comprise a hydrated flame-retardant mineral filler. This hydrated flame-retardant mineral filler acts mainly by the physical route by decomposing endothermically (e.g., release of water), which has the consequence of lowering the temperature of the layer and of limiting the propagation of flames along the cable. Reference is made especially to flame retardant properties.

The polymer layer may comprise from 20% to 70% by weight approximately of hydrated flame-retardant mineral filler relative to the total weight of the layer.

The hydrated flame retardant mineral filler may be a metal hydroxide such as magnesium hydroxide or aluminum trihydroxide.

In order to guarantee a HFFR (Halogen-Free Flame Retardant) cable, the polymer layer preferably does not comprise any halogenated compounds. These halogenated compounds may be of any types, such as for example fluorinated polymers or chlorinated polymers such as polyvinyl chloride (PVC), halogenated plasticizers, halogenated mineral fillers, etc.

The polymer layer may further comprise at least one inert filler.

The inert filler may be chalk, talc or clay (e.g. kaolin).

The polymer layer may comprise from 5% to 50% by weight approximately of inert filler relative to the total weight of the layer.

The polymer layer may comprise other additives that are well known to a person skilled in the art such as plasticizers, reinforcing agents, etc.

The polymer layer may have a thickness of at most 3 mm approximately, and preferably of at most 2 mm approximately.

The polymer layer is, preferably, a layer extruded by techniques well known to a person skilled in the art.

The electric cable of the invention is preferably a low-voltage power cable (in particular less than 6 kV) or medium-voltage power cable (in particular from 6 to 45-60 kV).

The cable of the invention may comprise several elongated electrically conductive elements in accordance with the first subject of the invention, in particular in the form of a strand.

According to a first variant, the polymer layer surrounds said elongated electrically conductive elements.

According to a second variant, the elongated electrically conductive elements are individually insulated and the cable comprises several polymer layers as defined above, each of the polymer layers individually surrounding each of the elongated electrically conductive elements.

The electric cable in accordance with the third subject of the invention may be manufactured according to a process comprising at least the following steps:

a. manufacturing at least one elongated electrically conductive element in accordance with the first subject according to a manufacturing process in accordance with the second subject of the invention, and b. extruding a polymer layer, around the elongated electrically conductive element as manufactured in the preceding step, in order to form an electric cable.

The polymer layer is as defined in the third subject of the invention.

A fourth subject of the present invention is a device comprising an electric cable in accordance with the third subject of the invention and at least one metal connector, characterized in that the metal connector is connected to at least one elongated electrically conductive element in accordance with the first subject of the invention or as obtained according to a process in accordance with the second subject of the invention.

The connector may be a crimping terminal, and in particular a standard tin-plated copper terminal, preferably an eyelet terminal.

Thus, within said device, the mechanical strength of the connector is improved and the maintaining of the connector-elongated electrically conductive element electrical contact is ensured.

DETAILED DESCRIPTION

Figure 1:
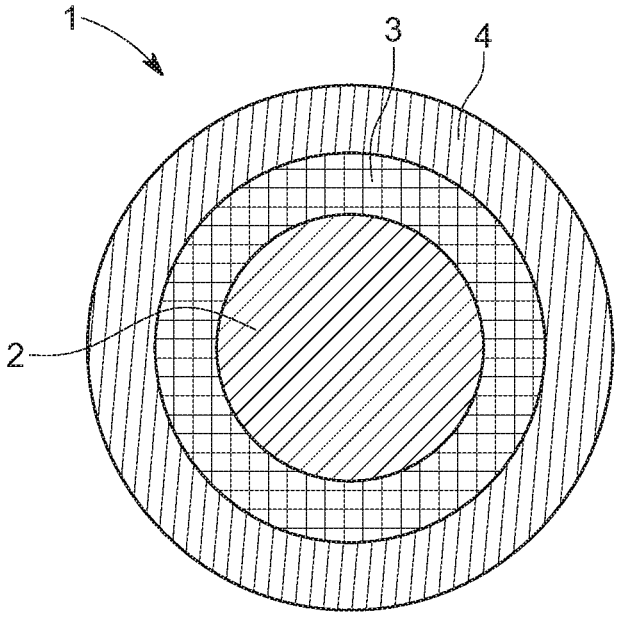
FIG. 1 schematically represents a structure, in cross section, of an electric cable according to the invention.

FIG. 1 shows an electric cable (1) in accordance with the invention comprising an elongated electrically conductive element comprising an aluminum or aluminum alloy core (2) and a copper or copper alloy layer (3) surrounding said aluminum or aluminum alloy core (2); and a polymer layer (4) surrounding said elongated electrically conductive element (2, 3).

Other features and advantages of the present invention will become apparent in light of the following examples with reference to the annotated figures, said examples and figures being given by way of nonlimiting illustration.

EXAMPLES

Example 1: Manufacturing of Elongated Electrically Conductive Elements in Accordance with the Invention and not in Accordance with the Invention In this example, three elongated electrically conductive elements A, B and C were compared with various volume contents of copper:

- an elongated electrically conductive element A: strand comprising 7 wires having a diameter of 0.302 mm, i.e. a total cross section of 0.5 $mm^2$,
- an elongated electrically conductive element B: strand comprising 7 wires having a diameter of 0.674 mm, i.e. a total cross section of 2.5 $mm^2$, and
- an elongated electrically conductive element C: single wire having a diameter of 1.45 mm, i.e. total cross section of 1.65 $mm^2$.

The volume contents of copper of each of the elongated electrically conductive elements A, B and C were:

- for the comparative elongated electrically conductive elements (i.e. not in accordance with the invention): 0% (pure aluminum) (conductors A-0, B-0, C-0), 10% (conductors A-10, B-10, C-10), 30% (conductors A-30, B-30, C-30) or 100% (conductors A-100, B-100, C-100), and
- for the elongated electrically conductive elements in accordance with the invention: 45% (conductors A-45, B-45, C-45), 60% (conductors A-60, B-60, C-60) or 80% (conductor C-80).

The various conductors were prepared according to the following steps:

i) a step of drawing at ambient temperature, so as to obtain aluminum wires (aluminum sold under the reference Al1350), aluminum wires coated with 10% by volume of copper relative to the total aluminum+copper volume (aluminum+copper sold under the reference CCA10), or copper wires (electrolytic copper sold under the reference ETP1);

ii) a step of depositing copper on the CCA10 wires from step i), by electrodeposition in order to achieve the desired volume % of copper, said electrodeposition being carried out using:

a copper plating bath based on methanesulfonic acid sold under the reference Copper Gleam RG10 which is a copper plating bath, a current density of 30 $A/dm^2$ with a voltage of less than 5 volts, a temperature of the bath between 45° C. and 55° C., and a deposition rate of the order of 6 μm/min;

iii) a step of annealing copper-coated CCA10 wires at a temperature of 250° C., for 2 hours;

iv) a stranding step for the conductors of A and B type;

v) a step of cutting the strands or wires into 15 cm long samples;

vi) a step of sheathing the samples with a heat-shrinkable polyolefin sheath having a crosslinking temperature at 105° C.; and vii) a step of crimping standard tin-plated copper eyelet terminals (connectors) at the ends of the samples.

Figure 2A:
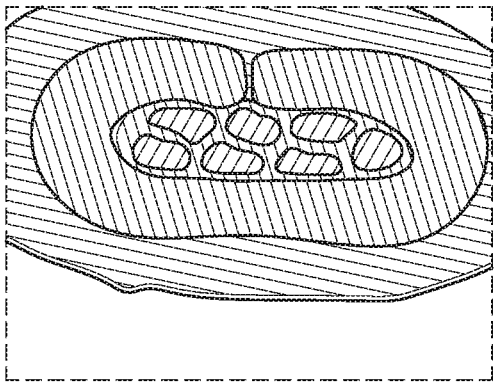
FIGS. 2*a* and 2*b* show the elongated electrically conductive element B-45 in accordance with the invention (FIG. 2*a*) and by comparison the elongated electrically conductive element B-10 not in accordance with the invention (FIG. 2*b*)
Figure 2B:
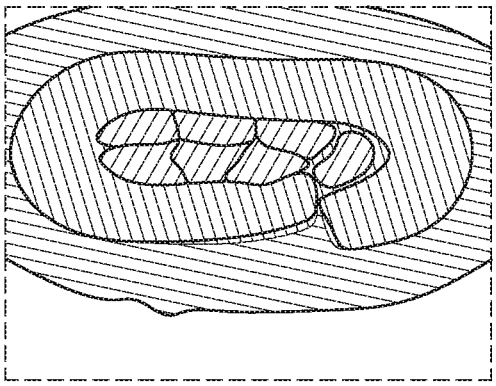

FIG. 2 shows the elongated electrically conductive element B-45 in accordance with the invention (FIG. 2*a*) and by comparison the elongated electrically conductive element B-10 not in accordance with the invention (FIG. 2*b*).

Figure 3:
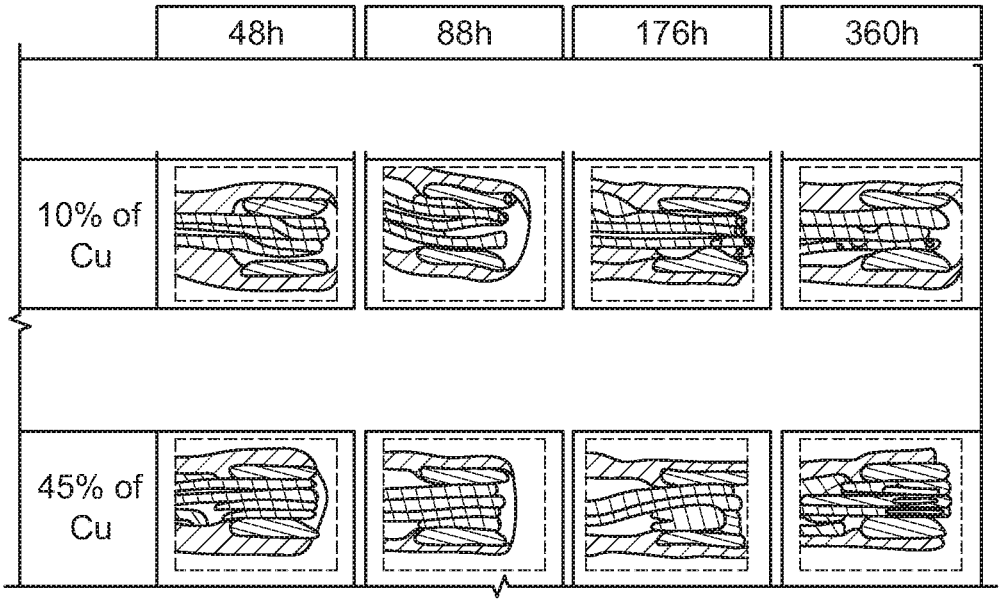
FIG. 3 is a micrograph cross section of the elongated electrically conductive element B-45 in accordance with the invention (FIG. 3*a*) and by comparison a micrograph cross section of the elongated electrically conductive element B-10 not in accordance with the invention (FIG. 2*b*), when these have undergone an exposure to salt spray for 48 h, 88 h, 176 h and 360 h.

FIG. 3 shows a micrograph cross section of the elongated electrically conductive element B-45 in accordance with the invention (FIG. 3*a*) and by comparison a micrograph cross section of the elongated electrically conductive element B-10 not in accordance with the invention (FIG. 2*b*), when these have undergone an exposure to salt spray for 48 h, 88 h, 176 h and 360 h.

Figure 4:
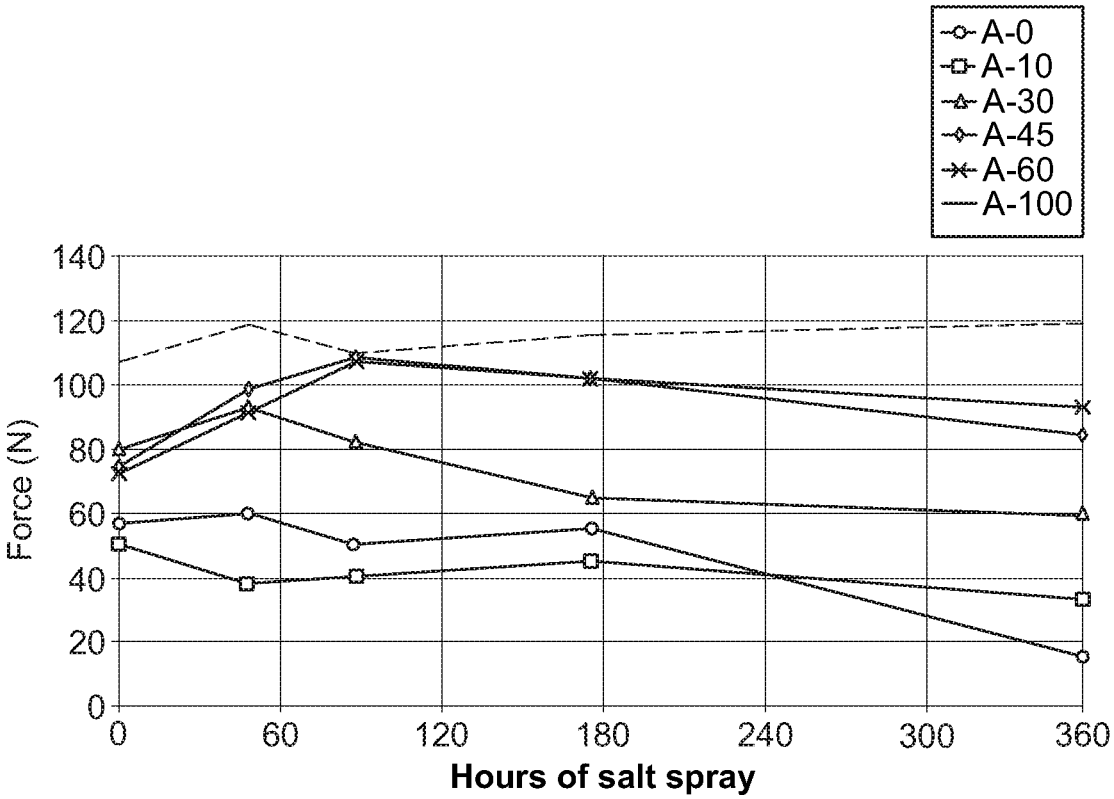
FIG. 4 is a chart of the mechanical strength of the terminals in a tensile test (in newtons N) as a function of the exposure time to the salt spray (in hours) for the conductors A-0 (curve with circles), A-10 (curve with squares), A-30 (curve with triangles), A-45 (curve with lozenges), A-60 (curve with crosses) and A-100 (curve with dotted lines).

FIG. 4 shows the mechanical strength of the terminals in a tensile test (in newtons N) as a function of the exposure time to the salt spray (in hours) for the conductors A-0 (curve with circles), A-10 (curve with squares), A-30 (curve with triangles), A-45 (curve with lozenges), A-60 (curve with crosses) and A-100 (curve with dotted lines).

From FIG. 4, it can be concluded that the mechanical strength of the terminals is significantly improved for the cables in accordance with the invention (volume content of copper greater than 30% of the volume of the conductor) even after 360 hours of salt spray. Thus, even though some corrosion is observed (cf. FIG. 3), the mechanical strength of the terminals is guaranteed over time, which is not the case for the mechanical strength of the comparative cables which drops after 60 hours of exposure (cf. conductor A-30).

The invention claimed is:

1. An elongated electrically conductive element comprising:

an aluminum or aluminum alloy core; and a copper or copper alloy layer surrounding said aluminum or aluminum alloy core, wherein the copper or copper alloy layer represents a volume greater than 30% of the volume of the elongated electrically conductive element, and wherein said element is capable of being obtained according to a process comprising at least one step i) of forming a copper of copper alloy layer around an aluminum or aluminum alloy core by continuous casting.

2. The element as claimed in claim 1, wherein the copper layer represents from 40% to 80% by volume, of the volume of the elongated electrically conductive element.

3. The element as claimed in claim 1, wherein the copper or copper alloy layer is the outermost layer of the elongated electrically conductive element.

4. The element as claimed in claim 1, wherein said element has an external diameter ranging from 0.01 to 30 mm.

5. The element as claimed in claim 1, wherein the copper or copper alloy layer is directly in contact with the aluminum or aluminum alloy core.

6. The element as claimed in claim 1, wherein the aluminum content of the aluminum alloy is at least 95.00% by weight.

7. The element as claimed in claim 1, wherein the copper content of the copper alloy is at least 95.00% by weight.

8. The element as claimed in claim 1, wherein said element has a reduction of at most 20%, in newtons, of the mechanical strength of the terminals in a tensile test, when it is subjected to an exposure to a salt spray of at least 50 h.

9. An electric cable, comprising at least one elongated electrically conductive element as defined in claim 1 and at least one polymer layer surrounding said elongated electrically conductive element.

10. The electric cable as claimed in claim 9, wherein the polymer layer is an electrically insulating layer.

11. The electric cable as claimed in claim 9, wherein the polymer layer comprises a polymer material chosen from crosslinked and non-crosslinked polymers, and polymers of inorganic type and of organic type.

12. The electric cable as claimed in claim 9, wherein the polymer layer does not comprise halogenated compounds and the cable is a HFFR cable.

13. A device comprising:

an electric cable having at least one elongated electrically conductive element as defined in claim 1, and at least one polymer layer surrounding said elongated electrically conductive element; and at least one metal connector, wherein said metal connector is connected to said at least one elongated electrically conductive element.

14. The element as claimed in claim 1, wherein the metals used during step i) of forming a copper or copper alloy layer around an aluminum or aluminum alloy core by continuous casting are:

for the copper or the copper alloy, in the liquid state, and for the aluminum or the aluminum alloy, in the liquid or solid state.

15. The element as claimed in claim 1, wherein the aluminum or the aluminum alloy is in the solid state, and step i) is a step i-1) during which copper or a copper alloy in the liquid state is cast on aluminum or an aluminum alloy in the solid state, or aluminum or aluminum alloy in the solid state is immersed in copper or a copper alloy in the liquid state.

16. The element as claimed in claim 1, wherein the aluminum is in the liquid state, and step i) is a step i-2) during which a hollow element made of copper or of copper alloy is preformed from copper or a copper alloy in the liquid state; then said hollow element is cooled; then the hollow element is filled with aluminum or an aluminum alloy in the liquid state; then the assembly obtained is cooled.

17. An elongated electrically conductive element comprising:

an aluminum or aluminum alloy core; and a copper or copper alloy layer surrounding said aluminum or aluminum alloy core, wherein the copper or copper alloy layer represents from 45% to 70% by volume of the volume of the elongated electrically conductive element.

* * * * *